US007715741B2

(12) United States Patent
Yamamoto

(10) Patent No.: US 7,715,741 B2
(45) Date of Patent: May 11, 2010

(54) IMAGE FORMING APPARATUS WITH A TONER IMAGE DENSITY FEATURE AND RELATED METHOD

(75) Inventor: Takeo Yamamoto, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 10/967,285

(22) Filed: Oct. 19, 2004

(65) Prior Publication Data

US 2005/0089340 A1 Apr. 28, 2005

(30) Foreign Application Priority Data

Oct. 24, 2003 (JP) ..... 2003-364757
Sep. 6, 2004 (JP) ..... 2004-258538

(51) Int. Cl.
*G03G 15/00* (2006.01)
*G03G 15/02* (2006.01)
*G03G 15/043* (2006.01)
*G03G 15/10* (2006.01)

(52) U.S. Cl. ..... 399/49; 399/50; 399/51; 399/60

(58) Field of Classification Search ..... 399/49, 399/50, 51, 60
See application file for complete search history.

(56) References Cited

U.S. PATENT DOCUMENTS 5,448,277 A 9/1995 Long
5,576,811 A * 11/1996 Kobayashi et al. ..... 399/60
6,236,827 B1 * 5/2001 Hada ..... 399/301
6,418,281 B1 7/2002 Ohki ..... 399/49
6,505,010 B1 * 1/2003 Izumizaki et al. ..... 399/39
6,952,283 B2 10/2005 Thieret
2003/0128381 A1 7/2003 Zaima ..... 358/1.9

FOREIGN PATENT DOCUMENTS

EP 1 326 426 A2 7/2003
JP 62-145266 * 6/1987
JP 7-58900 A 3/1995
JP 2000-238341 9/2000
JP 2002-287573 A 10/2002
JP 2003-29479 A 1/2003
JP 2003-202711 7/2003

OTHER PUBLICATIONS

Japanese Notification of Reason for Refusal dated Oct. 14, 2008 in Japanese Application No. 2040-258538, and English-language translation thereof.

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

An image forming apparatus includes an image forming part for forming a toner image on an image bearing body based on an image signal, and a density detection part for detecting a density of the toner image on the image bearing body, such that it is determined whether a normal image formed by the image forming part has a density detection area which should be detected, and if it is determined that the density detection area is present, image forming conditions are controlled based on a detection result of the density detection area.

1 Claim, 12 Drawing Sheets

IMAGE FORMING APPARATUS WITH A TONER IMAGE DENSITY FEATURE AND RELATED METHOD

BACKGROUND OF THE INVENTION

1. Field of the Invention

The present invention relates to an image forming apparatus, such as a copying machine, a printer, or a facsimile, for forming images according to an image forming process using an electrophotographic system or an electrostatic recording system.

2. Description of the Related Art

Conventionally, it has been desired that an image forming apparatus such as a copying machine or printer using an electrophotographic system should reproduce images from the same image data on a transfer material at a constant density.

To this end, the image forming apparatus forms a specific pattern of developed images (patches) for density detection on an image bearing body such as a photosensitive drum at a preliminary stage prior to the image forming process, that is, during a pre-rotation period upon completion of warm-up operation after startup. The image forming apparatus then reads out the density of the formed pattern, and based on the read density values, changes various parameters for determining the image forming conditions of the image forming apparatus, such as the amount of charge, the amount of exposure, an image information conversion table or so-called lookup table (hereinafter called "LUT"), a development field, and the amount of developer supply. Thus the image forming apparatus performs image control (pre-rotational image control) to stabilize the quality of images being formed.

Even when the tone characteristics of the image forming apparatus have changed due to changes in environmental conditions, this pre-rotational image control can be performed by forming patches on the image bearing body and reading their densities again to feedback the results to the various parameters for determining the image forming conditions, thereby stabilizing image quality in response to the changes in environmental conditions.

In the above-mentioned image forming method, however, the density may vary from image to image, because the image forming apparatus may not be able to respond to characteristics constantly varying due to long hours of image formation in the course of a day's work, such as changes in dark/light potential parts of the image bearing body or photosensitive drum, and changes in the amount of charge of developer. The variations in image density are brought to the fore as variations in color especially in such a color image forming apparatus that is required to carry out high-quality image formation.

In addition, since time-consuming and troublesome work is required for the above-mentioned pre-rotational image control, it is difficult to frequently carry out this control.

As a measure to solve this problem, a method called post-rotational image control is known as described in Japanese Patent Application Laid-Open No. 2000-238341 (corresponding to U.S. Pat. No. 6,418,281). In this method, one or more predetermined tone patterns are formed as patches on an image bearing body at intervals of a predetermined number of sheets after repetitions of the image forming process, and the densities of the tone patterns are read to control various parameters according to the read values.

Another method called inter-sheet image control is known as described in Japanese Patent Application Laid-Open No. 2003-202711 (corresponding to U.S. Pat. No. 2,003,128381 and EP-1326426). In this method, one or more tone patterns are formed in the same manner mentioned above on an image bearing body between image forming cycles at the time of continuous image formation at which images are continuously formed on multiple sheets, that is, at an interval between printing sheets, and the densities of the tone patterns are read to control various parameters according to the read values.

However, since the post-rotational image control is performed after image formation on a predetermined number of sheets, no image cannot be formed during the control period, reducing user productivity.

On the other hand, since the inter-sheet image control method forms patches between printing sheets, it requires a longer time to perform the control at an interval between printing sheets, causing a reduction in the number of formed images producible at the same processing rate.

In both of the foregoing image control methods, the image patterns are formed as patches other than images desired by the user to be formed in the image forming process, causing extra consumption of developer and promotion of contamination in the image forming apparatus.

SUMMARY OF THE INVENTION

It is an object of the present invention to provide an image forming apparatus capable of performing excellent image formation with smaller density and tonality variations at all times without causing a reduction in productivity of image formation and extra consumption of developer.

To attain the above object, a preferable image forming comprising:

image forming means for forming a toner image on an image bearing body based on an image signal;

density detection means for detecting the density of the toner image on the image bearing body; and control means, which determines whether a normal image formed by the image forming means has an area the density of which should be detected, and if determining that there is such a detection area, which controls image forming conditions based on the detection results of the density detection area.

DETAILED DESCRIPTION OF THE EMBODIMENTS

An image forming apparatus according to the present invention will now be described in detail with reference to the accompanying drawings.

First Embodiment

Figure 1:
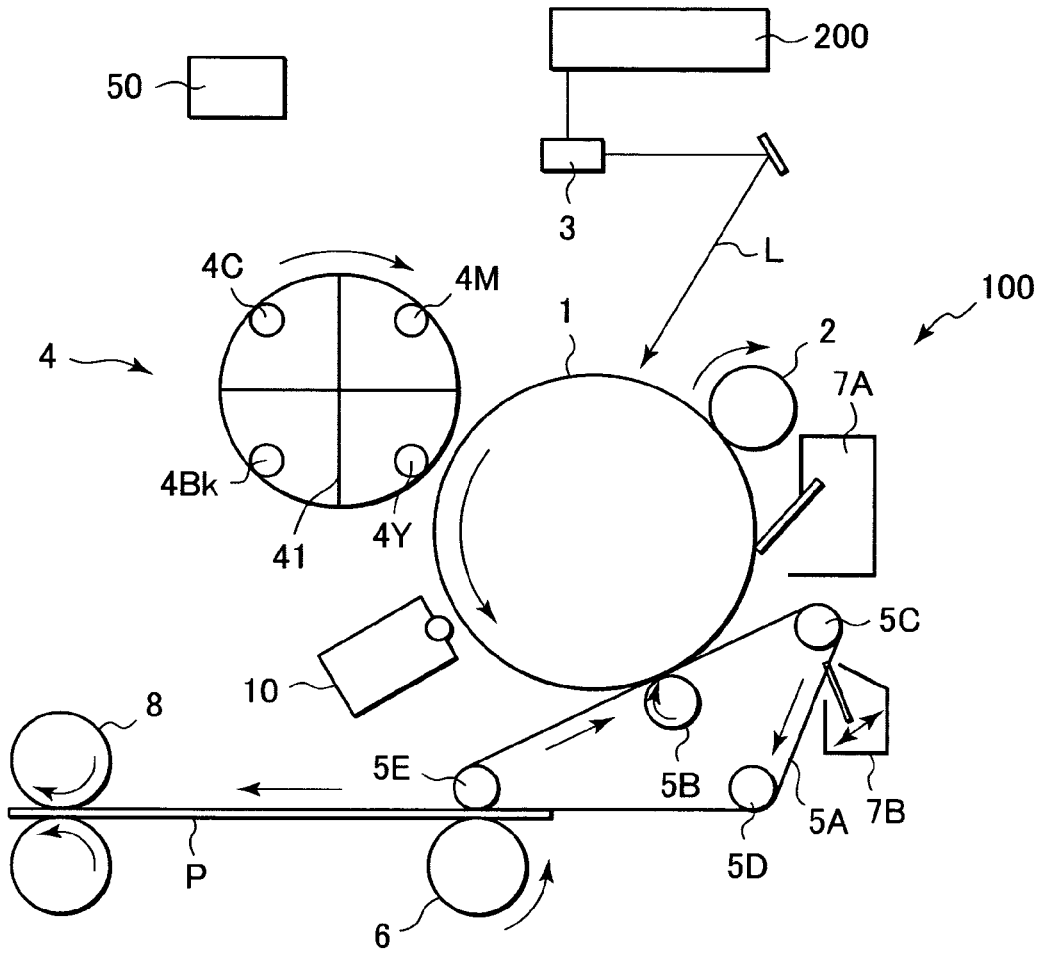
FIG. 1 is a schematic view showing an example of the structure of an image forming apparatus according to the present invention.

FIG. 1 shows a full-color printer as the image forming apparatus according to a first embodiment of the present invention.

An image forming apparatus 100 is either connected to or integrated with a reader part 200. The reader part 200 is a device for converting outside information into an image signal, such as an imaging apparatus for reading images of an original from the outside or a personal computer. For example, a luminance signal from the original image read by the imaging apparatus or an image signal transferred from the personal computer is sent to the image forming apparatus 100.

A full-color printer (hereinafter called the "printer") 100 as the image forming apparatus 100 shown in FIG. 1 is equipped with a photosensitive drum 1 as an image bearing body, and operates the photosensitive drum 1 to form an image (toner image) developed with developer on the drum 1 based on image information from the reader part 200 according to an image forming process basically consisting of charging, latent image forming, developing, transferring the toner image from the photosensitive drum 1 to a transfer material P, and fusing of the toner image on the transfer material P.

The printer as an image forming means for performing these steps of the image forming process includes a charge roller 2 as charge means for uniformly charging the surface of the photosensitive drum 1 by applying a charge bias in the charging step, and an exposure means 3, such as a laser writing unit, for irradiating laser light L sequentially according to image information on each of colors, yellow, magenta, cyan, and black, from the reader part 200 in the latent image forming step. The photosensitive drum 1, which is uniformly charged to a predetermined potential, is scanned by irradiating the laser light L in the latent-image forming step, that is, in an exposure step in this case, so that the surface potential of an irradiated area on the photosensitive drum 1 is changed and a latent image is formed in the area.

The printer 100 also includes multiple developing units 4 as a development means, each containing each color of developer composed of toner and carrier mixed at a predetermined ratio. Here, the developing units 4 are a yellow developing unit 4Y containing yellow developer, a magenta developing unit 4M containing magenta developer, a cyan developing unit 4C containing cyan developer, and a black developing unit 4Bk containing black developer. The four developing units 4 are provided in a rotary developing unit 41. In the developing step, these developing units 4 provides developer to the latent image area formed on the photosensitive drum 1 sequentially to form a toner image on the photosensitive drum 1, respectively.

After a toner image is formed on the photosensitive drum 1 by means of one of the developing units 4, the visible toner image is transferred onto an intermediate transfer belt 5A as an intermediate transfer body by a transfer roller 5B as transfer means in the transfer step. After that, another toner image formed by another developing unit 4 is transferred and superimposed on the previously transferred toner image, and so on. Thus four toner images formed by the four developing units 4 are superimposed one upon another on the intermediate transfer belt 5A. In the transfer step, the toner images transferred from the photosensitive drum 1 and superimposed on the intermediate transfer belt 5A are further transferred to a desired transfer material P by means of a transfer roller 6. The unfixed, superimposed toner image formed on the transfer material P is fused by a fuser 8 as fusing means in the fusing step.

In the above-mentioned image forming process, toner remaining on the photosensitive drum 1 is cleaned off by a cleaner 7A, and toner remaining on the intermediate transfer belt 5A is cleaned off by a cleaner 7B. The cleaning means removes the previously formed toner image for the next image formation.

The following is a detailed description of the structural elements, that is, the photosensitive drum 1 as the image bearing body used in the image forming process, and the image forming means. The image forming means include the charge roller 2 as the charge means, the exposure means 3 as the latent-image forming means, the developing units 4 as the development means, and the intermediate transfer belt 5A and the transfer rollers 5B, 6 as the transfer means.

Photosensitive Drum 1: In the embodiment, the photosensitive drum 1 is an OPC (Organic Photo-Conductor) drum that is 80 mm in diameter and 320 mm long.

The OPC is a photoconductor of negative charge polarity (negatively charged photoconductor) made up of a conductive drum base body of aluminum or the like, and a photosensitive layer (photoconductive layer) formed around the outer surface of the base body. The OPC drum is driven to rotate in the direction indicated by the arrow at a process speed (peripheral speed) of 150 mm/sec.

Charge Roller 2: The charge roller 2 is a mutilayer roller formed of a central metal core, an elastic conductive layer formed around the outer circumferential surface of the central metal core concentrically and integrally with the central metal core, and a resistive layer formed around the outer circumferential surface of the elastic conductive layer.

For example, the elastic conductive layer is a monolayer or multilayer structure of conductive rubber or the like with a resistivity of $10^4$ ohm-cm or less, while the resistive layer is a monolayer or multilayer structure of conductive rubber or the like with a resistivity of $10^7$ to $10^{11}$ ohm-cm and a thickness of about 100 μm or less.

The charge roller 2 is rotatably supported by bearing members, not shown, at both ends of the metal core, and pressed on the photosensitive drum 1 by pressing means, not shown, with a predetermined pressing force. In the embodiment, the rotation of the charge roller 2 is driven by the rotation of the photosensitive drum 1.

A charge bias as a predetermined bias voltage is applied from a power supply, not shown, to the metal core of the charge roller 2 so that the outer circumferential surface of the photosensitive drum 1 will be charged uniformly. In the embodiment, an AC charging system that provides excellent potential convergence is used as a power supply for applying the charge bias. The AC charging system superimposes a DC bias onto an AC bias. If the AC bias is equal to or greater than a predetermined electric field, the potential on the photoconductor will converge substantially in the same manner as the DC bias.

In the embodiment, the charge bias for image formation uses an AC bias in the form of a sine wave with a frequency of 1200 Hz and a Vpp of 1.7 kV. Then, by applying −620 V as the DC bias, −600V can be obtained as the potential on the surface of the photosensitive drum 1.

Exposure Means 3: Image information on each color, that is, yellow, magenta, cyan, or black, for emitting laser light L (exposing the photosensitive drum 1 to laser light L) is either read from an original image by an image reader or transferred from a personal computer or the like. Based on the image information on the four colors, an image processing unit in the reader part 200 performs predetermined image processing on the image information to create image data. The image data on the four colors are transferred to the laser writing unit 3 in synchronization with the reading operation of the image reader in the reader part 200.

In the embodiment, the amount of exposure of the laser light L emitted from the laser writing unit 3 is adjusted for each color so that the surface potential of an exposed region on the photosensitive drum 1 will be charged to −180 V to form a solidly shaded image from image data. In other words, the exposure of the laser light L to a latent image region reduces (the negative amplitude of) the surface potential of the latent image region from the surface potential of −600 V on the surface charged by the charge roller 2. Thus a latent image is formed in the region the surface potential of which has been changed on the photosensitive drum 1.

In the embodiment, the latent image forming means is the exposure means used in the electrophotographic process, but an electrostatic recording system can also change the surface potential of an image region on the photosensitive drum 1 to form a latent image.

Developing Units 4: The developing units 4M, 4Y, 4C, and 4Bk, respectively provided for each color and arranged in the rotary developing unit 41, all use a two-component development system. The developer is two-component developer composed of toner particles and magnetic particles (carrier particles) mixed at a predetermined ratio.

In each developing unit 4, the developer is attracted and retained on a developing sleeve as a developer carrying body having a magnet therein, and moved to the surface of the photosensitive drum 1 by the application of a developing bias, not shown, thus forming an image of desired density. In the embodiment, all colors of toner have negative polarity (negative toner).

In the embodiment, the developing bias for image formation uses an AC bias in the form of a rectangular wave having a frequency of 2400 Hz and a Vpp of 2.0 kV, with a DC bias of −450 V superimposed on it.

The ratio of developer components in each developing unit 4 is so set that the maximum density (optical density) of each color will be 1.8. In the embodiment, the ratio of toner and carrier (hereinafter called "T/C ratio") is set at 10% for each color.

Transfer Means: The intermediate transfer belt 5A is a flat intermediate transfer member ranging over a wide area of the photosensitive drum 1 including a transfer region so that toner images formed by the developing units 4 on the photosensitive drum 1 will be transferred one upon another onto the intermediate transfer belt 5A.

The length of the perimeter of the intermediate transfer belt 5A is an integral multiple of the length of the circumference of the photosensitive drum 1 (e.g., two to five times). In the embodiment, the length of the perimeter is set to 2×80×p (mm). The intermediate transfer belt 5A is made of monolayer conductive rubber with a thickness of 10 μm and a resistance of $1\times10^9$ ohms.

Three rollers 5C, 5D, 5E including a drive roller 5C driven by a drive mechanism, not shown, enables the intermediate transfer belt 5A to circulate in the direction indicated by the arrow in synchronization with the rotation of the photosensitive drum 1 at the same speed as the rotational speed (peripheral speed) of these rollers.

The transfer roller 5B is a primary transfer means for transferring each color-toner image formed on the intermediate transfer belt 5A; it is provided on the backside of the intermediate transfer belt 5A facing the photosensitive drum 1, that is, facing the transfer region of the photosensitive drum 1. The transfer roller 5B is formed of a central metal core and a medium-resistance elastic layer formed around the outer circumferential surface of the central metal core concentrically and integrally with the central metal core. The transfer roller 5B in the embodiment is a conductive rubber roller with a resistance of $5\times10^6$ ohms and a diameter of 16 mm.

A predetermined bias opposite in polarity to the toner images, that is, a positive bias in the embodiment, is applied as a primary transfer bias from a power supply, not shown, to the metal core of the transfer roller 5B so that each color-toner image formed on the photosensitive drum 1 will be transferred onto the intermediate transfer belt 5A.

The transfer roller 6 is a secondary transfer means for transferring the toner images transferred and held on the intermediate transfer belt 5A to a desired transfer material P; it is formed of a central metal core and a medium-resistance elastic layer formed around the outer circumferential surface of the central metal core concentrically and integrally with the central metal core. The transfer roller 6 in the embodiment is a conductive rubber roller with a resistance of $5\times10^8$ ohms and a diameter of 16 mm.

A predetermined bias opposite in polarity to a polarity of the toner images, that is, a positive bias in the embodiment, is applied as a secondary transfer bias from a power supply, not shown, to the metal core of the transfer roller 6 so that each color-toner image formed on the intermediate transfer belt 5A will be transferred onto the transfer material P. The transfer material P on which the toner images have been transferred is transported to the fuser 8 by which the toner images are fused on the transfer material P. The sequence of image forming operations is completed with this fusing step.

Thus the image forming apparatus of the embodiment performs image formation according to the image forming process using the above-mentioned image forming means. However, an image forming apparatus 100 of an electrophotographic type like a printer is prone to vary its characteristics depending on the surrounding environment or usage pattern. This makes it difficult to always output images with steady color tones under fixed image forming conditions. Therefore, such an image forming apparatus generally detects the density of a developed image formed on an image bearing body like the photosensitive drum 1 to control the image forming conditions for the image forming means to perform each image forming step based on the detected information so as to obtain desired tone characteristics, thus performing image control. Specifically, the control of the image forming conditions is made, for example, by changing the amount of charge, the amount of exposure, the developing bias, the amount of developer supply, etc.

The following describes a density detection means used for the image control of the embodiment.

Figure 2:
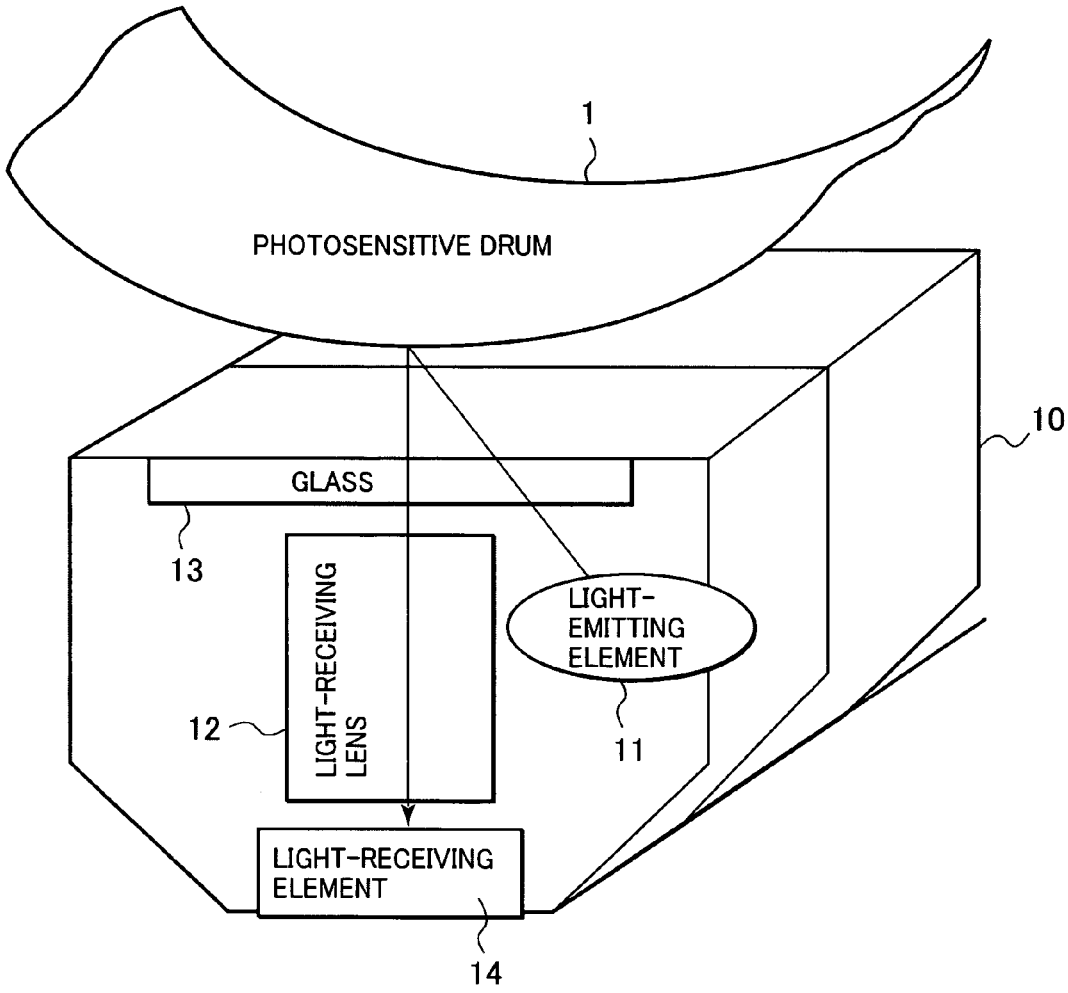
FIG. 2 is a schematic perspective view showing an example of density detection means according to the present invention.

FIG. 2 is a schematic view of a density detection means 10, such as a contact image sensor (CIS) (line sensor) for detecting the toner density on the photosensitive drum 1 according to the embodiment.

In the embodiment, a glass plate 13 is arranged 5 mm away from the surface of the photosensitive drum 1 so that light emitted from a light-emitting element 11 through a light-receiving lens 12 will form an image on a light-receiving element 14. In the embodiment, a white LED is used as the light-emitting element 11. The density of reflected light for each color is then detected on the light-receiving element 14 by separating RGB colors using electric circuitry as shown in FIG. 3.

Figure 3:
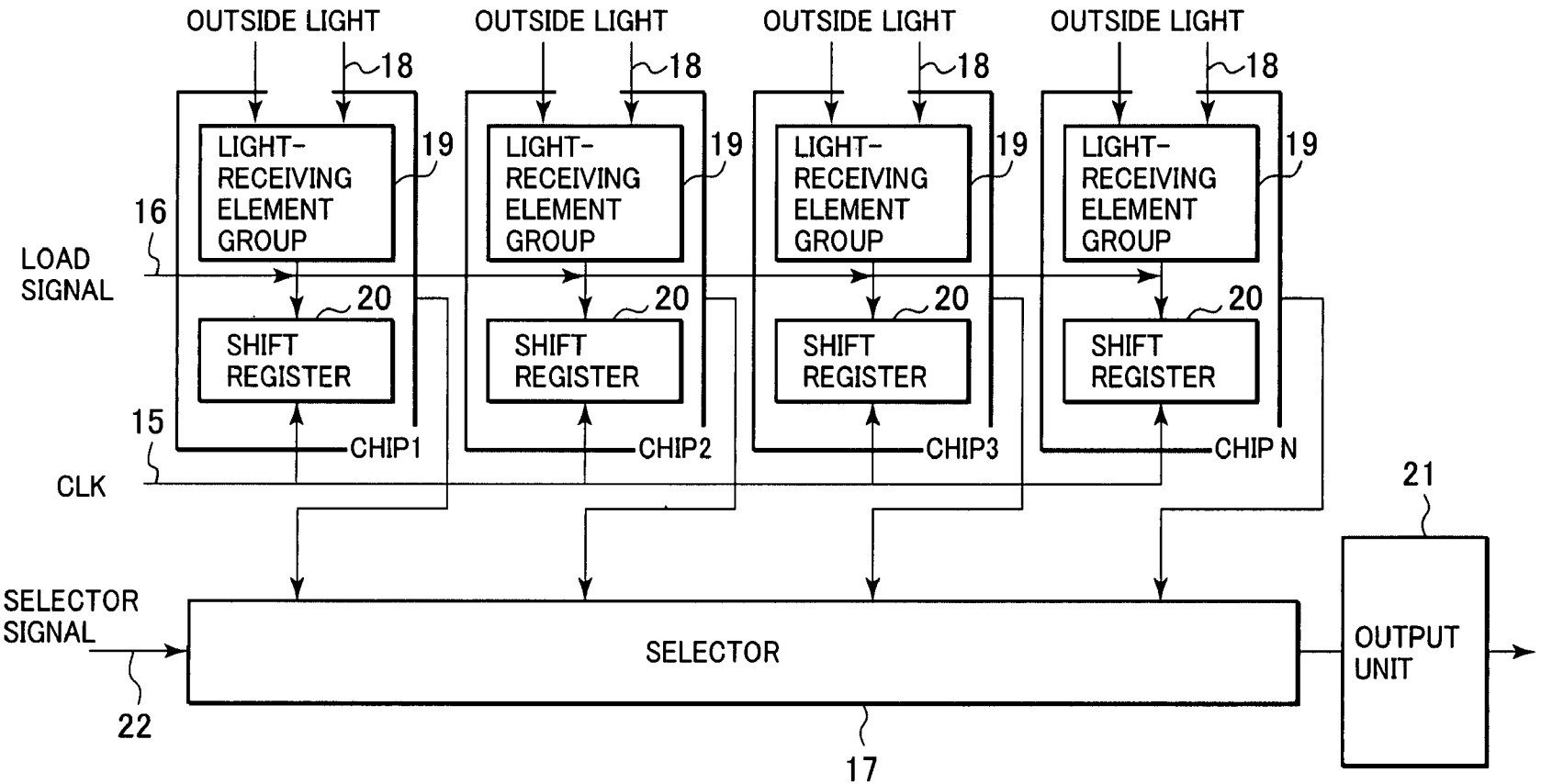
FIG. 3 is a block diagram showing the operation of the density detection means according to the present invention.

FIG. 3 shows the electric circuit structure of the CIS. The CIS is composed of multiple chips 1 to N for converting a signal received at the density detection means 10 into an image density signal, a selector 17 for selecting each signal converted by each chip, and an emitter follower circuit as an output unit 21. Each chip is composed of a light-receiving element group 19 and a shift register 20. As not shown in FIG. 3, it also includes a power supply, a ground, and LEDs as light-emitting elements.

On each chip, light energy 18 received at the light-receiving element group 19 of the sensor 10 is converted to analog data (potential). All pieces of data from the chip 1 to chip N are triggered by a load signal 16 and loaded into the shift register 20 of each chip.

The shift register 20 synchronizes with an external CLK 15 to shift the set data to the output side. The output signal from each chip is connected to the selector 17 so that a chip corresponding to a region to be outputted will be selected according to a selector signal 22 from a control unit, thus outputting the data of the selected chip to the output unit 21.

The data of the selected chip is repeatedly outputted as long as the selector signal 22 remains unchanged.

The selector signal 22 can be switched to enable detection across two or more chips.

The CIS in the embodiment is 310 mm long, with the glass plate 13 arranged 5 mm away from the surface of the photosensitive drum 1 as mentioned above. The element groups have a reading resolution of 600 dpi, that is, a resolution of 7330 pixels.

In the embodiment, the image control based on the detection results from the density detection means 10 is performed during a pre-rotation period, that is, by a so-called pre-rotational image control method.

Figure 4:
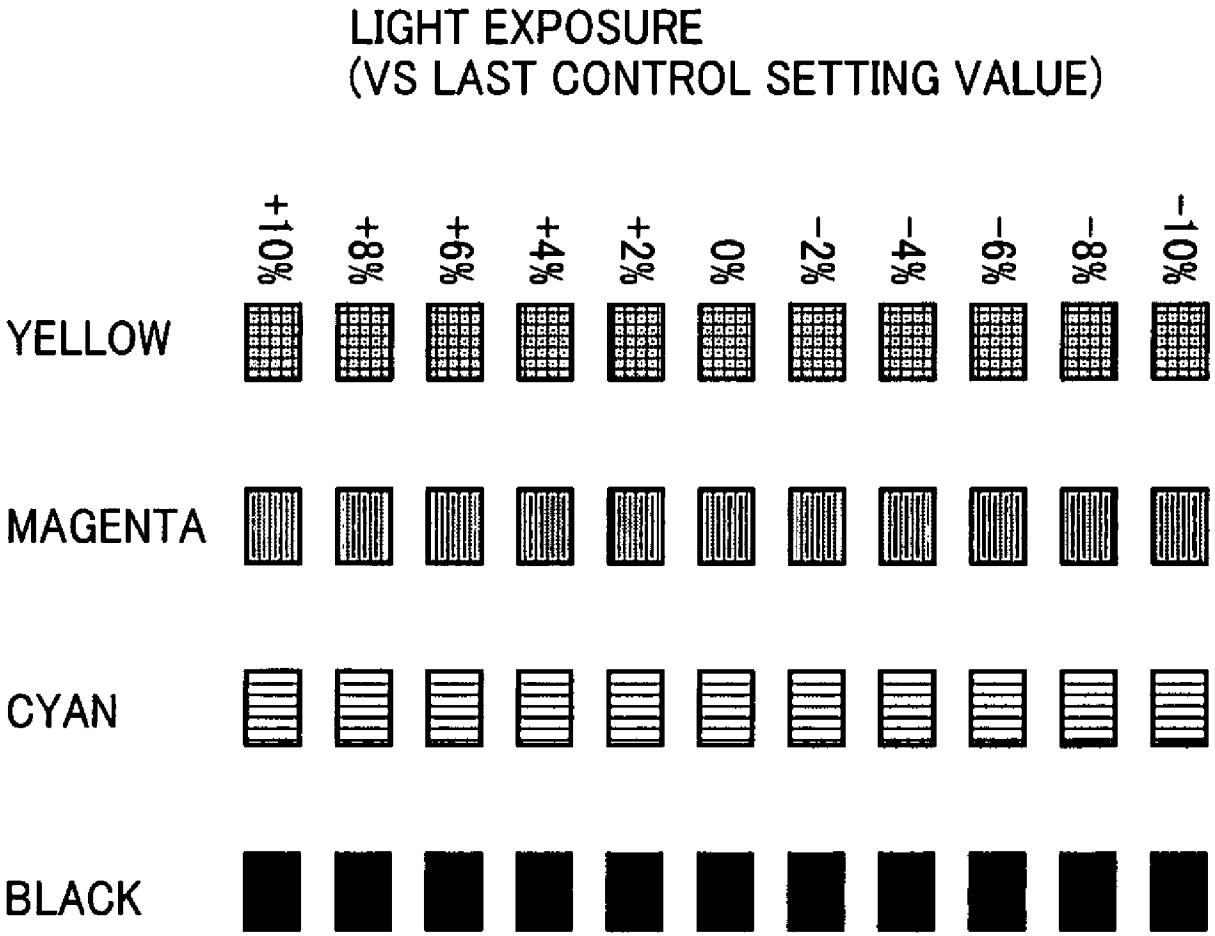
FIG. 4 is a front view showing an example of developed image pattern for density detection used for pre-rotational image control.

In the pre-rotational image control method, a pattern of developed images (patches) for density detection as shown in FIG. 4 is formed for each color after a warm-up operation of the image forming apparatus to obtain the maximum density for each color. In other words, images are formed on the photosensitive drum 1 by setting the value of input density data to 255.

Various parameters such as the amount of laser exposure are changed to form the patterns of multiple patches shown in FIG. 4. In the embodiment, 11 pieces of 5×5 mm density patches are formed for each color in a range of plus/minus 10 percent from the initial set value of light exposure in increments of 2 percent. Then, the image density of each patch formed on the photosensitive drum 1 is read by the density detection means 10 provided in the main body of the image forming apparatus to detect the image density in a manner described later. Then, based on the read image density, the adjustment of the amount of exposure, that is, so-called maximum density control is made by interpolation or extrapolation so that the image density will be a desired density (1.8) as the maximum density on the transfer material P.

The light amount determined at this point is used as the reference light amount for the next pre-rotation control. In the embodiment, although the maximum density is controlled by adjusting the amount of exposure, any other parameter, such as the amount of charge, the developing bias, the amount of developer supply (T/C ratio), and the LUT to be described later, may be controlled instead.

Figure 5:
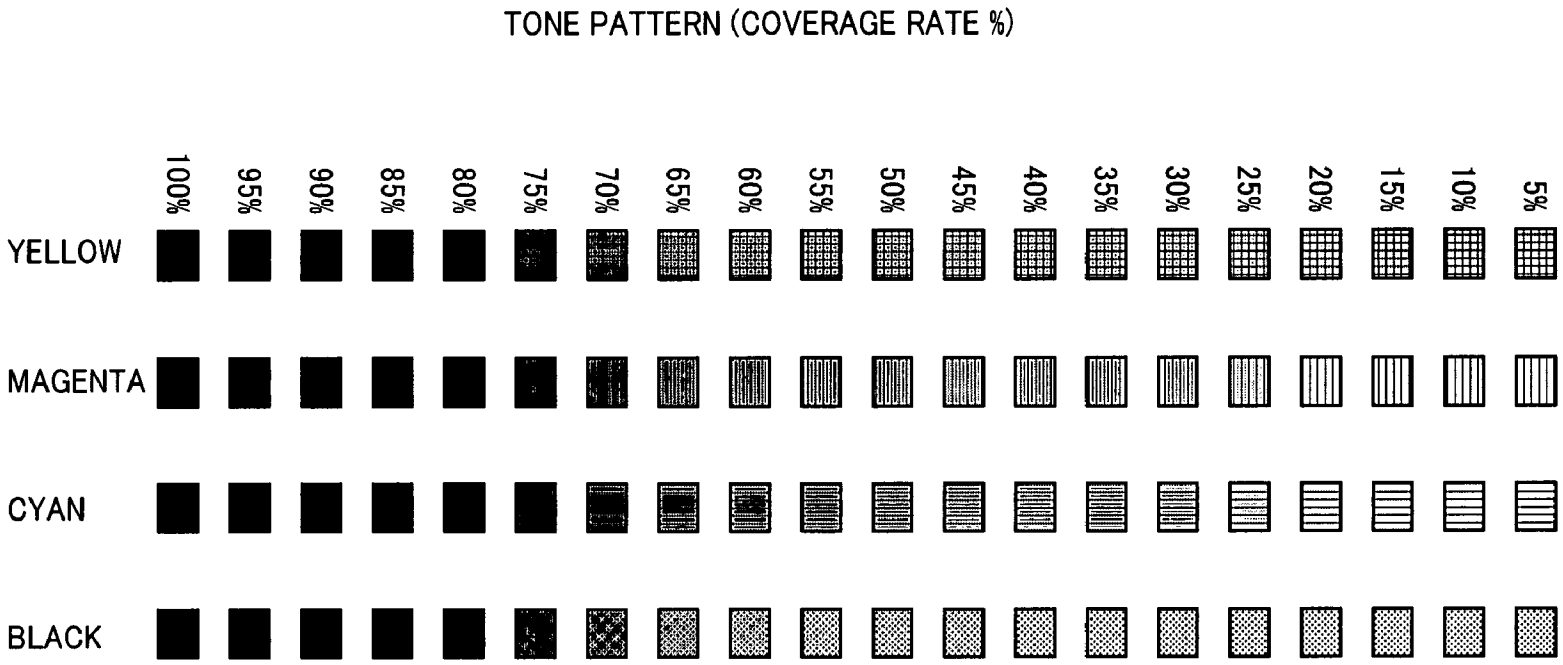
FIG. 5 is a view showing another example of developed image pattern for density detection used for pre-rotation image control.

After such maximum density control, a tone pattern of 20 pieces of 5×5 mm density patches is formed for each color as shown in FIG. 5 by varying coverage rates in increments of 5 percent. Then, the tone density pattern is read by the density detection means 10 to update the LUT, that is, to perform a so-called tone control so that desired tone characteristics can be obtained.

To obtain desired tone characteristics, the embodiment further includes an image information conversion means for setting and holding the LUT used to convert an image signal from the reader part 200 into a signal value that fits the characteristics of the engine, that is, into an image density signal for an image to be formed. For a color machine, the LUT is provided for each of colors, yellow, magenta, cyan, and black, respectively, and optimized for each color to output a desired full-color image. The LUT is an image information conversion table that exhibits the relationship between an input image density signal, which is an image signal of image data inputted to the image information conversion means from the outside, and an output image density signal converted by the image information conversion means to represent the density of an image to be formed. In other words, the LUT exhibits conversion conditions from the input image signal to the output image signal.

Then, the density of the tone pattern formed on the photosensitive drum 1 is detected, and based on the detection results, the LUT is corrected as the above-mentioned image control.

The following describes image formation processing using the LUT.

Figure 6:
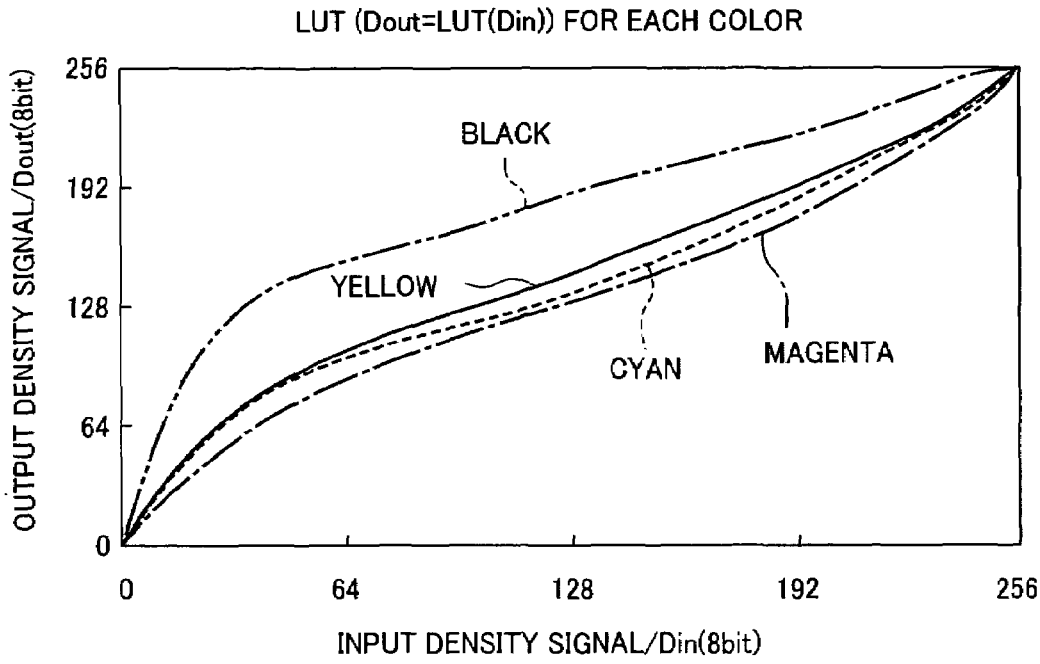
FIG. 6 is a graph showing an example of an image information conversion table according to the present invention.

FIG. 6 shows a typical LUT for each color in the embodiment. The LUT shown in FIG. 6 assumes a case where an 8-bit digital signal is rendered as one of 256 levels of tone. In other words, the input density signal Din and the output density signal Dout are normalized to 256 levels of tone, that is, Dout=LUT(Din) is in a one-to-one relationship with Din.

Figure 7:
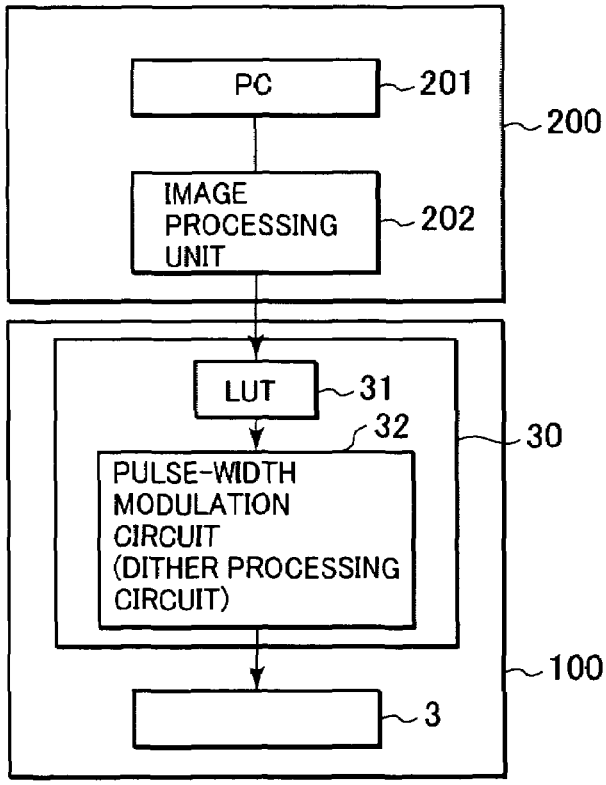
FIG. 7 is a block diagram showing an example of image information conversion means according to the present invention.

In the image forming process, tone control to optimize image density is performed according to the LUT. FIG. 7 is a block diagram showing an example of the circuit arrangement including the image information conversion means 30 for obtaining a tone image to be rendered as an image the density of which has been optimized by the LUT. In the reader part 200 as the unit for reading an image from outside information as mentioned above, an image processing unit 202 converts image signals from the outside information, for example, acquired from an imaging apparatus or personal computer (PC) 201, into density signals on a one-by-one basis. The characteristics of the density signal converted in the reader part 200 is then corrected by the LUT 31 included in the image information conversion means 30 in such a manner that the corrected density signal will be a signal corresponding to gamma characteristics set by default for the image forming apparatus 100, that is, the density of the original image will match the density of the printed image.

After that, a pulse-width modulation circuit 32 performs pulse width modulation (PWM) at 600 lines per inch on all the colors Y, M, C, and Bk of image signals corrected by the LUT 31 in the image information conversion means 30, and sent to the exposure means 3. In the embodiment, the tone reproduction method using PWM is used, any other tone reproduction method, such as to use any other number of lines or dither processing, may be used instead.

The laser source of the exposure means 3 outputs the laser light L to scan the photosensitive drum 1, so that a latent image having predetermined tone characteristics is formed on the photosensitive drum 1 by changing the area of dots to reproduce the tone image through the developing, transfer, and fusing steps, thereby enabling the image formation of an image the density of which has been optimized.

The LUT is altered by uniformly increasing or decreasing the level of tone based on the detection results of the density patches as a tone pattern, but the present invention is not limited to this tone control according to the embodiment. For example, the desired tone area may be divided into finer areas, or the number of tone levels may be increased or decreased. Further, in the embodiment, the tone is controlled by the LUT, but it may be controlled by changing the amount of exposure, the amount of charge, the developing bias, the amount of developer supply (T/C ratio), etc.

In addition, although the densities of the patches formed on the photosensitive drum 1 are detected, such a method to detect the densities of patches formed on the transfer material P may also display the same effect.

When the image forming process continues for a long time after completion of the pre-rotational image control, post-rotational control or inter-sheet image control is performed in the conventional. In either case, however, an image pattern other than images desired by the user needs forming, causing extra consumption of developer and promotion of contamination in the image forming apparatus.

In a conventional apparatus, such patch images are formed during a post-rotation period (an interval after completion of normal image formation until the next standby state) or at an interval between sheets (between the previous image and the next image in the normal image forming process). In other words, the patch images are formed during a period other than the normal image forming periods to perform various kinds of control using the patch images.

Therefore, according to the present invention, the density of a toner image formed in the normal image forming process and to be transferred to a recording material is detected to perform various kinds of control based on the detection results without creation of additional patch images as a test pattern.

The following describes an image control method as the main point of the present invention.

During the image forming process, image data sent from the reader part 200 is separated into each density information on each of four colors, yellow, magenta, cyan, and black in the embodiment, converted by the LUT for each color, and transferred to the exposure device.

Figure 8:
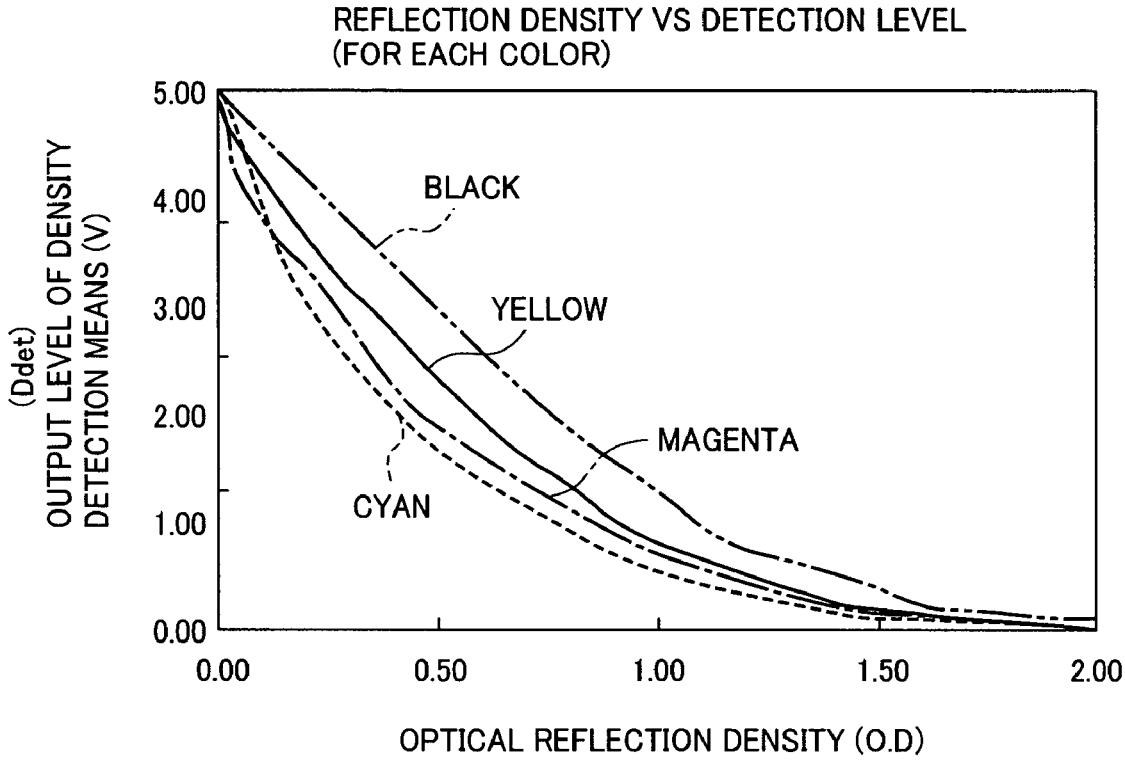
FIG. 8 is a graph showing the relationship between output level of density detection means and optical density according to a first embodiment of the present invention.

In this method, a desired density can be determined at the time of color separation. FIG. 8 shows the relationship between the density of each color and the output level of the density detection means 10. The output level is so adjusted that it will be 5 V at a density of 0 and 0 V at an infinite density (absolute dark). Based on this relationship, the optical reflection densities (O.D) as the detection results from the density detection means 10 are converted to respective detected density signals Ddet and normalized to 256 levels.

In the embodiment, the range of density (optical reflection density) is divided into three steps: I=0.3 to 0.6, II=0.7 to 1.0, and III=1.6 to 1.8. Then, when input density information on each color separated by the density detection means 10 indicates that the density of each color in a predetermined density range is distributed over a predetermined width (predetermined amount or predetermined number of pixels), that is, when the input density information contains five adjacent pixels or more in each of the three density ranges in the main scanning direction as the direction to scan the leaser light L, the density of an image in the image region from which the density information has been obtained is detected by the density detection means 10.

If the density information falls within a desired density range, no change is made to the various parameters, while if the density information contains an undesired density exceeding a predetermined value, the LUT is altered.

The reason for dividing the density range into three steps is that the other density ranges outside the three density ranges are considered controllable with the same stability as long as the three density ranges can be controlled. The number of steps and the range of each density region are not limited to those of the embodiment, and they may be changed accordingly depending on the characteristics of the image forming apparatus used.

Further, the reason for setting five adjacent pixels or more as the predetermined width of image data to be detected is that using consecutive, i.e. five adjacent pixels is considered adequate to perform accurate detection, though detection is possible on an isolated pixel basis. The detection of adjacent pixels is more accurate than that of an isolated pixel, and this makes it possible to improve the detection accuracy. The direction in which the pixels are adjacent to each other is not limited to the main scanning direction, and it may be the sub-scanning direction. Alternatively, the pixels may be diagonally adjacent to each other. Although the image processing method of the embodiment is to perform PWM control at 600 lines per inch, it is preferable that the predetermined width of density information should be changed depending on the image processing method.

Even if the densities of the five adjacent pixels are not uniform, the average value of those of the five adjacent pixels may be used as the density of the image region as long as all the densities fall within any one of the three density ranges, for example, from 0.3 to 0.6.

Further, when the reading resolution of the density detection means is different from the basic resolution of the image forming apparatus, it is also preferable that the predetermined width of density information should be changed in the same manner.

In the above-mentioned structure of the embodiment, the LUT is corrected when the input density deviates by 5 percent or more from the desired density range. For example, when the input density is equal to a reflection density of 0.4 (Din=57), if the detected density is equal to a reflection density of 0.38 (Ddet=54) or less or a reflection density of 0.42 (Ddet=59) or more, the LUT is corrected.

As apparent from the above description, the embodiment performs image control on images formed during the image forming process, rather than by forming patches for image control. It can eliminate the need to form such patches. The control of the image forming apparatus as described above is performed by a control means 50 as shown in FIG. 1.

Figure 9:
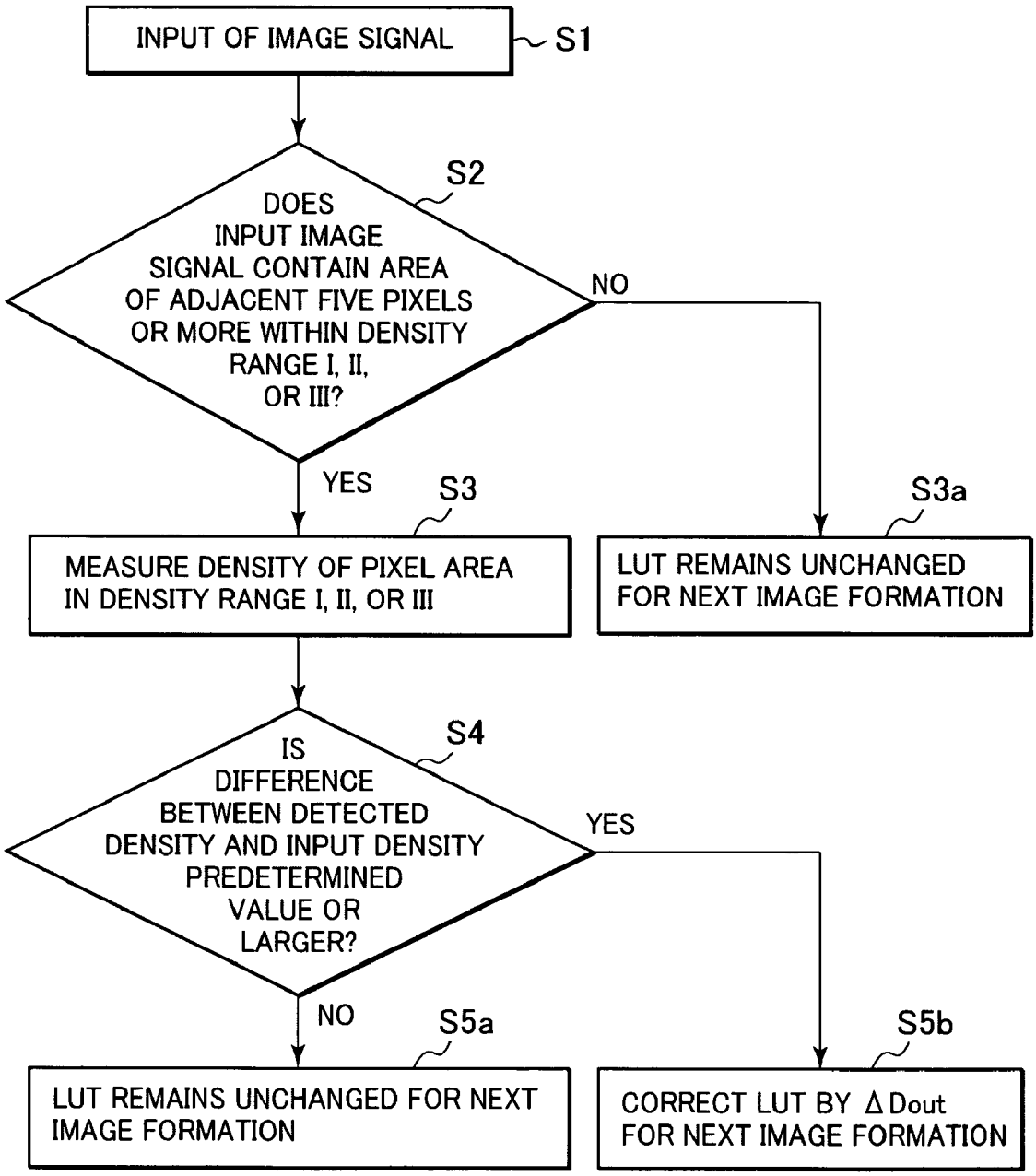
FIG. 9 is a flowchart showing an example of image control according to the present invention.

The flow of the above-mentioned image control will now be described with reference to the flowchart of FIG. 9.

When an image forming signal is sent (S1), it is determined from the input image signal whether the image data from the reader part 200 contains an area of consecutive five adjacent pixels or more having density information in the reflection density range I of 0.3 to 0.6 (Din=42 to 85), the reflection density range II of 0.7 to 1.0 (Din=99 to 142), or the reflection density range III of 1.6 to 1.8 (Din=226 to 255) (S2). If there is no such area, the LUT is not altered (S3*a*), while if there is such an area, the density detection means 10 detects the density of the area (S3).

It is then determined whether the difference between the density detection result of step S3 and the input density is a predetermined value or larger (S4). If the difference is smaller than the predetermined value, the LUT is not altered (S5*a*), while it is the predetermined value or larger, part of the LUT corresponding to the density range is altered (S5*b*).

The details of how the LUT is altered are as follows: When in any one of the density ranges I, II, and III the difference between the input density and the output density is 5 percent or more (S1 to S4), a correction value ΔDout for the output density signal Dout is determined in step S5*b* from Equation (1) according to the difference ΔD=Din−Ddet between the input density signal Din and the Output density signal Dout so that the LUT will be corrected to satisfy Equation (2):

$$\Delta D\text{out}=\text{INT}(A*\Delta D/D\text{in}*\text{LUT}(D\text{in})) \quad (1)$$

$$\text{LUT}'(D\text{in})=\text{LUT}(D\text{in})+\Delta D\text{out} \quad (2)$$

Here, LUT is an uncorrected state, LUT' is a corrected state, and INT( ) is a function that represents the largest integer not greater than the numerical value within the parentheses. Then, A is a coefficient that is different in each density range. The coefficient is 0.5 in the density range I, 0.6 in the density range II, and 0.8 in the density range III.

In the embodiment, the correction weight to be assigned varies in each density range, because too much correction in low density areas could cause too much visual change. Of course, the coefficient A may be 1 in any density range.

Figure 10:
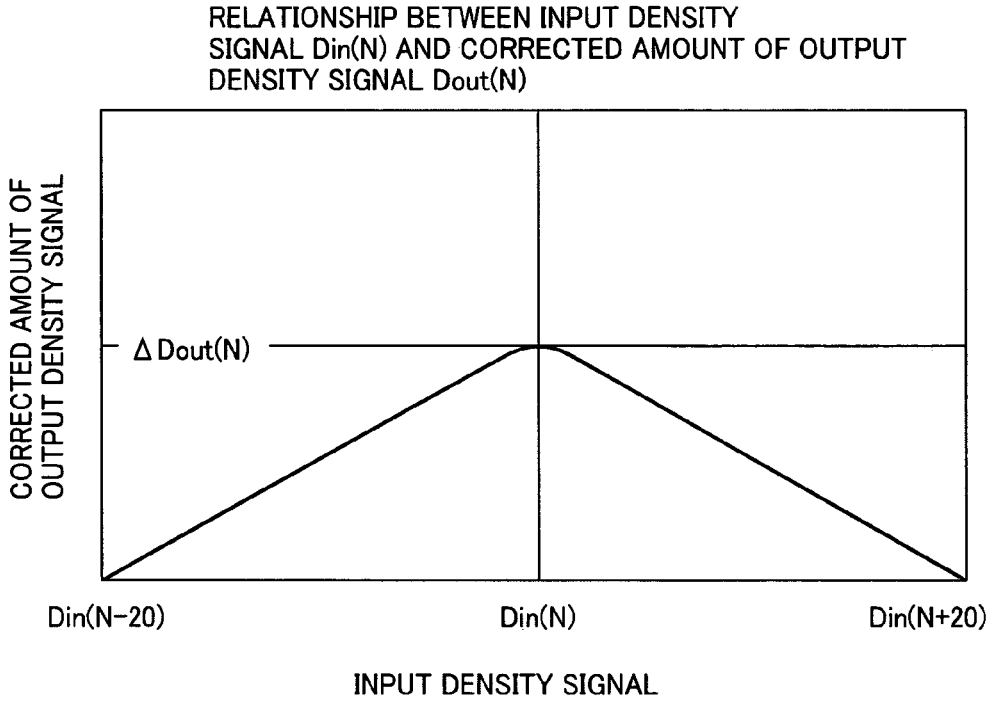
FIG. 10 is a graph showing the relationship between input density signal and correction amount of output density signal according to the first embodiment of the present invention.

If the output density signal Dout is close to the density Din of the input image signal, the LUT is so corrected so that plus/minus 20 levels of the LUT will vary linearly with respect to the center value of the detected densities. Thus the LUT is partially corrected. FIG. 10 shows the relationship between input density signal Din (N) and corresponding corrected amount of output density signal ΔDout (N). Note here that the value of each corrected amount is normalized to an integer (using the above-mentioned function INT or by rounding off the number to the nearest integer).

Test results of image formation on 5,000 A4-landscape sheets using the image formation control according to the embodiment show that the range of density variations is 5 percent or less in all the density ranges with a color difference ΔEab of 3 or less all over the color spectrum.

In a system as a comparative example, which does not perform image control during image formation, the maximum range of density variations is 40 percent and the maximum value of ΔEab exceeds 12, seriously impairing the constancy of image quality. On the other hand, conventional systems using post-rotation control and inter-sheet control show almost the same results as the embodiment, but the post-rotation control system must perform control once every 500 sheets, and the inter-sheet control system needs 20 mm more clearance between sheets than the system of the embodiment. As a result, the productivities of the conventional image control systems are only 88 and 91 percent of that of the embodiment respectively. In addition, both of the conventional control methods consume more toner than that of the embodiment. Specifically, they consume about 0.5 mg more toner for each color per A4 sheet.

In the pre-rotational image control method of the embodiment, either the maximum density control or the tone control may be carried out.

Not only that, but even the pre-rotation control may not be carried out. The user or service personnel may select whether to perform such a control.

Second Embodiment

In the first embodiment, the control is made by correcting only the LUT. However, there is a case where correction is not possible for a certain density range.

Specifically, when a density drop in the high-density range III of 1.6 to 1.8 occurs in the image forming apparatus, for example, due to a radical change in environment, temperature or humidity during image formation in the course of a day's work, light potential V1 may increase over a predetermined width or more or the amount of charge of developer may go too high. In such a case, a 255-level output image signal Dout may not be able to be outputted at the maximum density of 1.8.

Therefore, in this embodiment, image formation is performed by changing control conditions according to the density range. Specifically, the amount of exposure from the exposure means is changed in the density range III of 1.6 to 1.8, while the LUT is corrected in the density ranges I and II in the same manner as the first embodiment.

Figure 11:
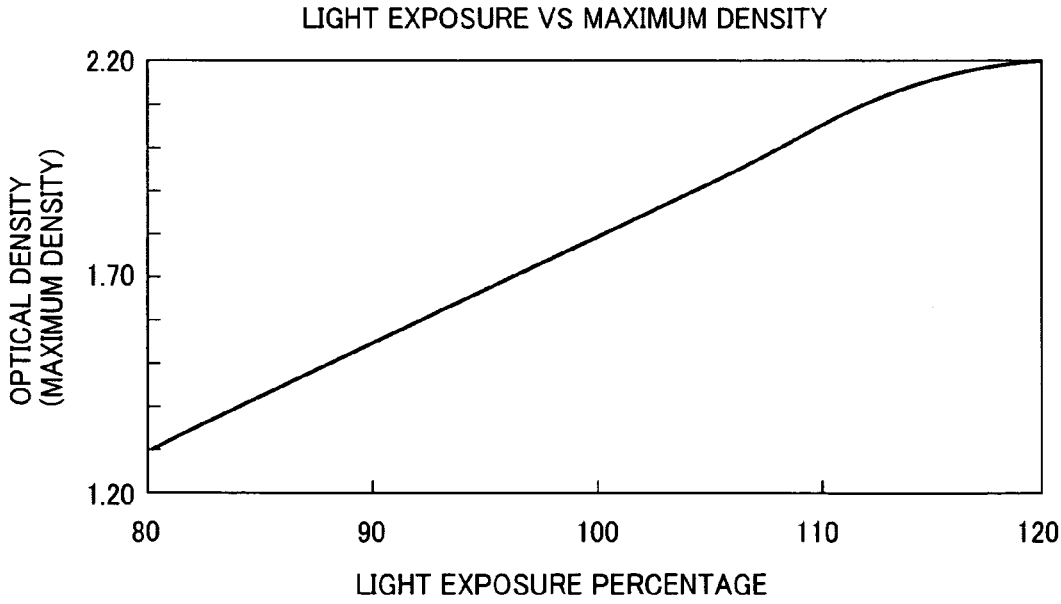
FIG. 11 is a graph showing a correspondence table between the amount of exposure of exposure means and image density according to the present invention.

FIG. 11 shows the relationship between amount of exposure and maximum density. In this case, when density deviates in the density range III over a predetermined width or more, image formation is performed by correcting laser power Lp by ΔLp, that is, by setting the amount of exposure to Lp+ΔLp. ΔLp is determined using the following equation (3):

$$\Delta Lp=B*\Delta D/Din*Lp \quad (3)$$

Here, B is calculated from the relationship shown in FIG. 11. In the embodiment, B=0.8 is set, but it is not limited to 0.8.

For example, when the input density signal Din is 255 (with a reflection density of 1.8) and the detected density signal Ddet is 241 (with a reflection density of 1.7), since the amount of light (stationary light) on the photosensitive drum 1 is 0.5 mW in the embodiment, the amount of exposure is so controlled that the amount of exposure LP will be 0.52 mW (=0.5+0.02) as shown in the following equations (4) and (5). In this case, an excellent image can be obtained without any density drop in the high density range.

$$\Delta Lp=0.8\times(255-241)/255\times0.5=0.02 \quad (4)$$

$$LP=0.5+0.02=0.52 \quad (5)$$

The amount of exposure determined at this point is used as the reference exposure amount for the next pre-rotation control.

Figure 12:
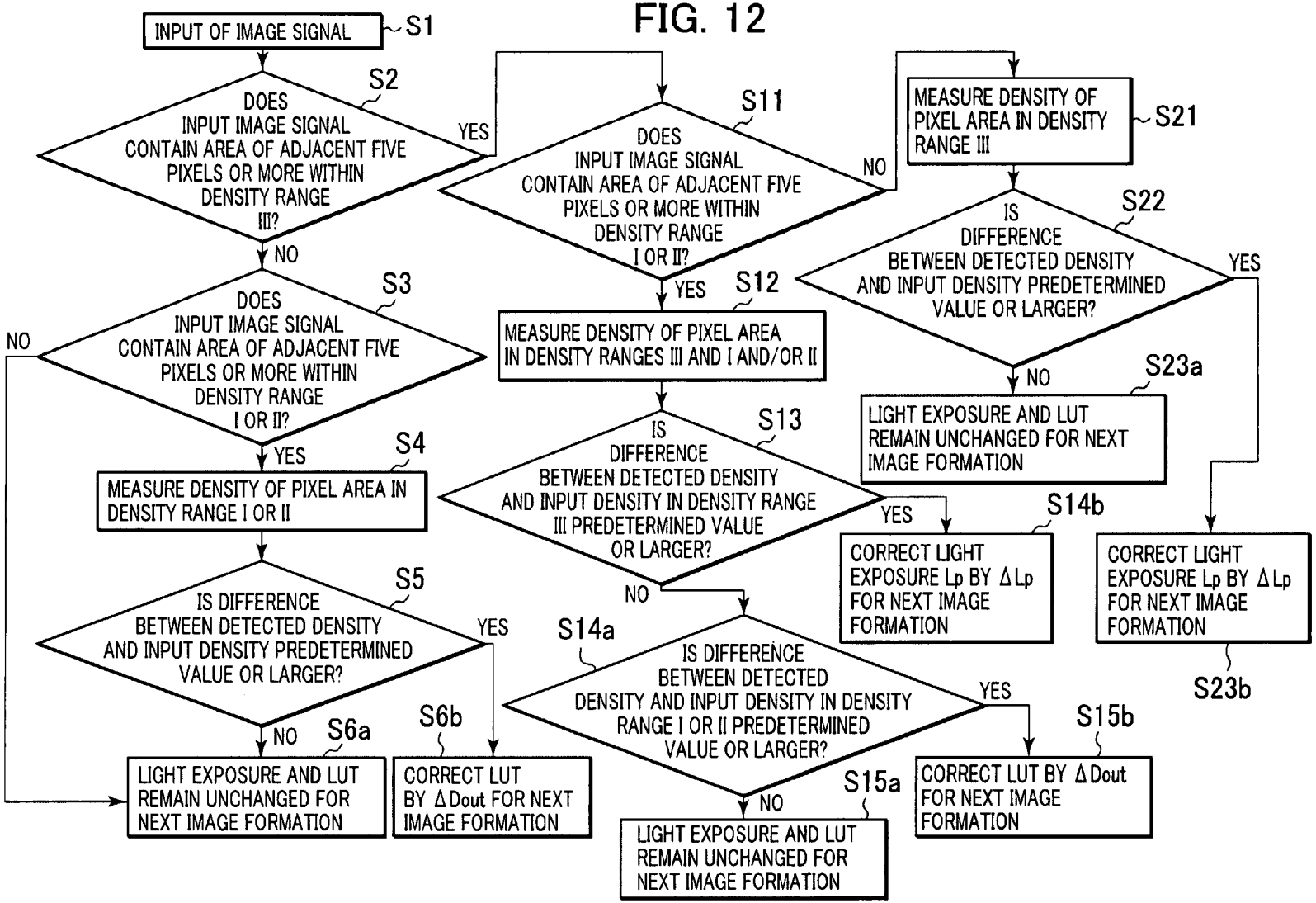
FIG. 12 is a flowchart showing another example of image control according to the present invention.

As shown in the flowchart of FIG. 12, it is first determined whether the formed image contains an area of five adjacent pixels or more in the density range III (S2). If there is no such area, the same image control as in the first embodiment is performed on the density range I or II (S3 to S6*a* or S6*b*).

On the other hand, when it is determined in step S2 of FIG. 12 that there is such an area of five adjacent pixels or more, it is determined whether there is an area of five adjacent pixels or more in any other density range (S11). If there is no such area, the following image control steps S21 to S23*a* or 23*b* in the second embodiment are performed.

On the other hand, if correction is needed not only in the density range III but also in either or both of the density ranges I and II at the same time, density in each density range is detected (S12), and the following control steps S13 and S14*a* or S14*b* in the second embodiment are performed in the density range III. This is because, though the amount of density variation is small, the density slightly varies in the density ranges I and II with a change in the amount of exposure. In other words, the correction of the exposure amount results in characteristic changes all over the density ranges in contrast to the correction of part of the LUT in the first embodiment.

Figure 16:
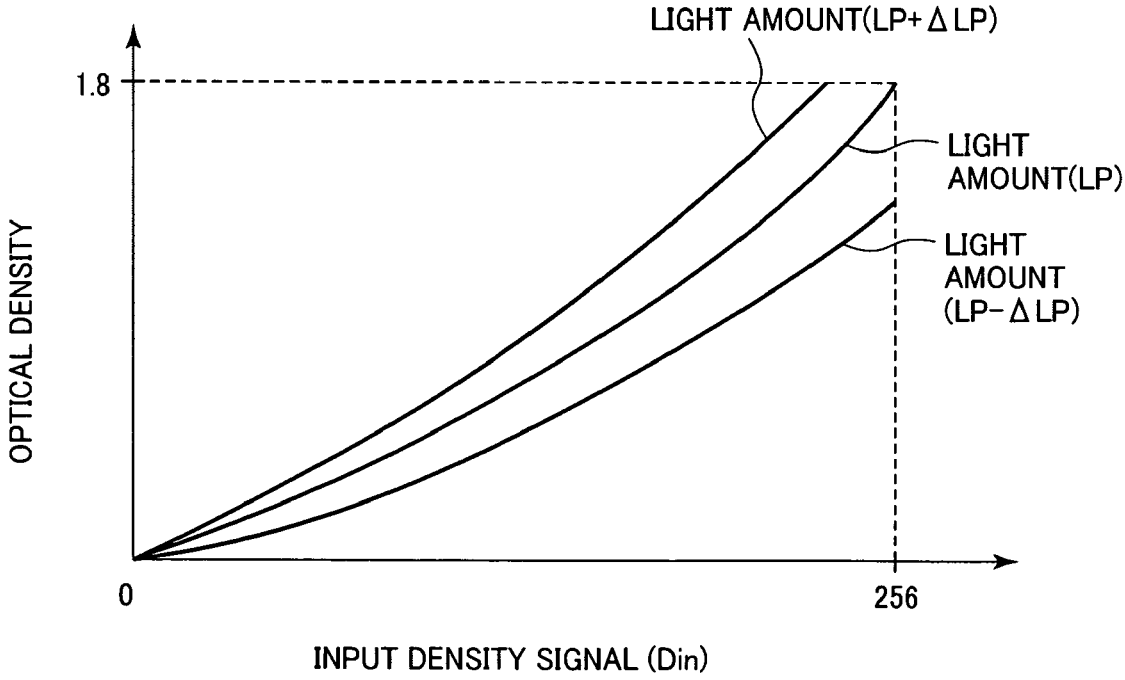
FIG. 16 is a graph showing the relationship between input density signal and optical density when the amount of exposure is changed.

FIG. 16 shows the relationship between input density signal (Din) and optical image density when the light amount is changed. As shown in FIG. 16, the relationship between the input density signal and the optical density varies all over the density ranges with a change in the light amount. The larger the level of the input density signal, the higher the rate of change of the optical density with respect to the input density signal.

In the flowchart of FIG. 12, when the procedure reaches the last step in each flow, it returns to step S1 to follow the flow starting from step S1. For example, after completion of correction of the exposure amount at step S23*b*, the procedure returns to step S1 to correct the LUT in the density range I or II as needed.

Figure 13:
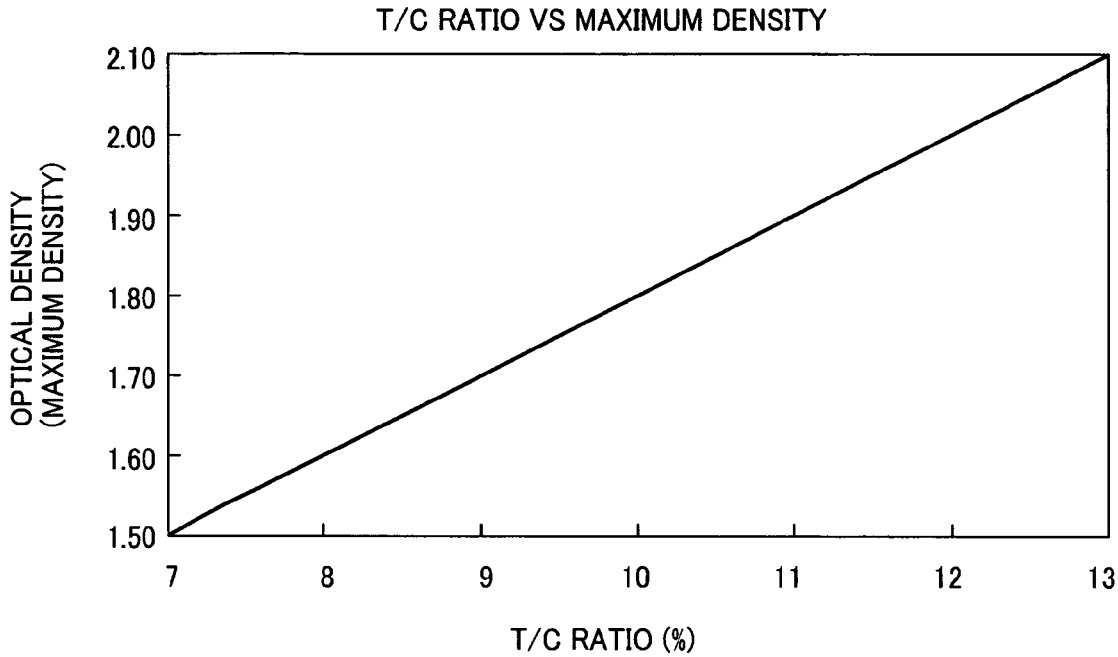
FIG. 13 is a graph showing a correspondence table between image density and T/C ratio of developer according to the present invention.
Figure 14:
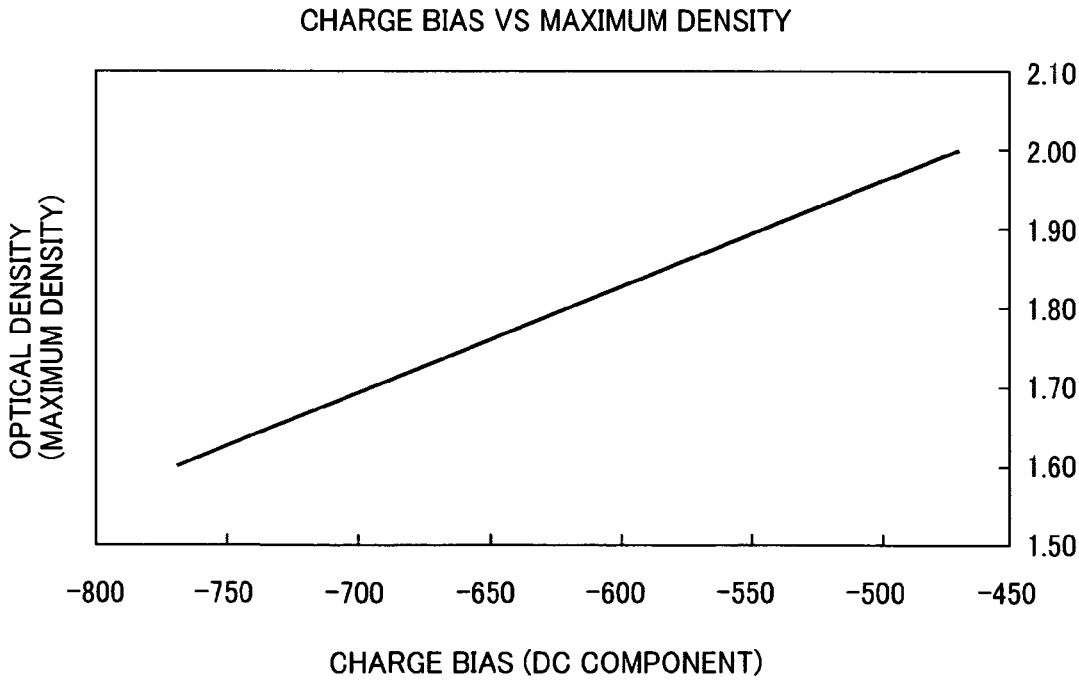
FIG. 14 is a graph showing a correspondence table between image density and charge bias applied by charge means according to the present invention.
Figure 15:
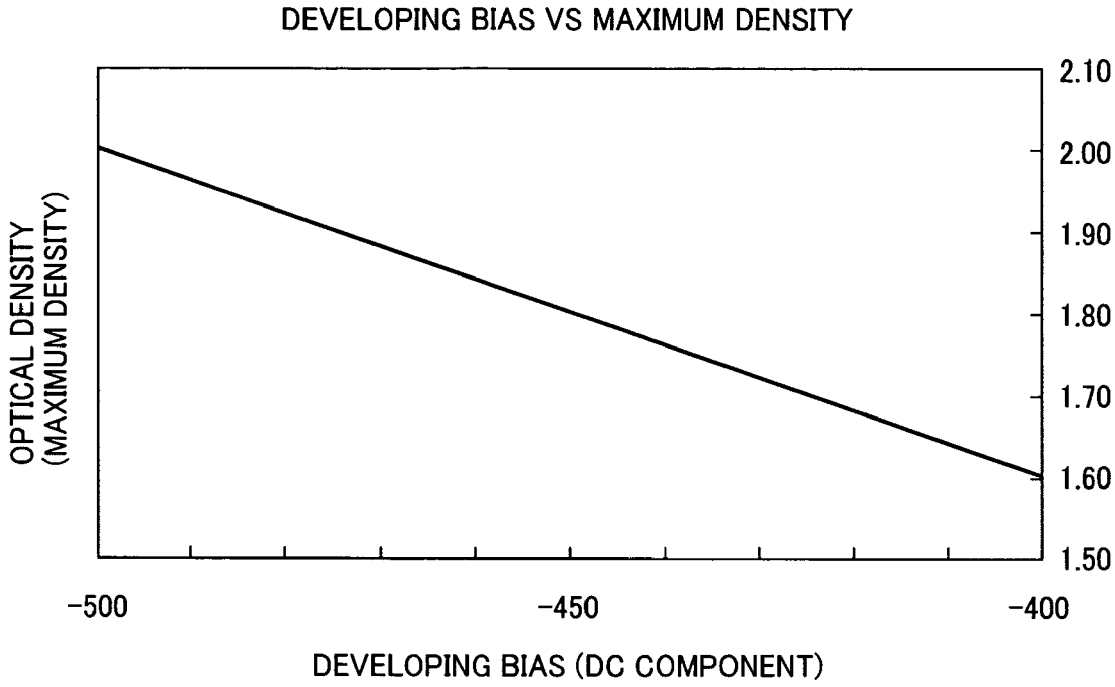
FIG. 15 is a graph showing a correspondence table between image density and developing bias according to the present invention.

In this embodiment, the amount of exposure is controlled to correct the density range III, but any other parameter, such as the amount of charge, developing bias, or the T/C ratio as the amount of developer supply, may be controlled accordingly using the correspondences of variations in the density range III to the amount of change shown in each of FIGS. 13 to 15.

The control of the amount of exposure, the amount of charge, the developing bias, or the amount of developer supply may also be used to correct any density range other than the density range III.

Although a single-drum image forming apparatus is described in the first and second embodiments, the present invention is also applicable to any multi-drum image forming apparatus such as a four-drum image forming apparatus.

Further, the dimensions, material, shape, and position of each structural element of the image forming apparatus described above are not intended to limit the scope of the present invention unless otherwise specified.

This application claims priority from Japanese Patent Application No. 2003-364757 filed Oct. 24, 2003 and Japanese Patent Application No. 2004-258538 filed Sep. 6, 2004, which are hereby incorporated by reference herein.

What is claimed is:

1. An image forming apparatus comprising:

an electrophotographic photosensitive member;

an image information converting device configured to convert an input image signal into an output image signal having tone information corresponding to tone information of the input image signal based on a lookup table;

an exposure device configured to expose the electrophotographic photosensitive member with a laser beam based on the output image signal so as to form an electrostatic latent image;

a developing device configured to develop the electrostatic latent image on the electrophotographic photosensitive member using toner to form a toner image;

a density detection device configured to detect a density of the toner image on the electrophotographic photosensitive member; and a control device configured to correct power of the laser beam or to correct the lookup table, when the density detection device detects the density of a detection area corresponding to a signal area in a toner image of a normal image in a case where the input image signal of the normal image has the signal area in which more than a predetermined number of pixel signals within a predetermined density range exist adjacent to each other and a difference between detected density information obtained by the density detection and density information of the pixel signals in the signal area corresponding to the detection area is equal to or more than a predetermined value, there by resulting in the detected density information being outside of an allowable range, wherein the control device corrects the power of the laser beam when the detected density information of the detection area corresponding to the signal area with the highest density among a plurality of signal areas corresponding to different density ranges is outside of the allowable range, and the control device corrects the lookup table when the detected density information of the detection area corresponding to the signal area other than the signal area with the highest density is outside of the allowable range.

* * * * *